US005323956A

United States Patent [19]

Marcontell

[11] Patent Number: 5,323,956

[45] Date of Patent: Jun. 28, 1994

[54] PAPERBOARD BOWL WITH ARCHED WALLS

[75] Inventor: William A. Marcontell, Covington, Va.

[73] Assignee: Westvaco Corporation, New York, N.Y.

[21] Appl. No.: 24,290

[22] Filed: Mar. 1, 1993

[51] Int. Cl.[5] ..... B65D 5/56

[52] U.S. Cl. ..... 229/109; 229/3.1; 229/939; 220/443

[58] Field of Search ..... 229/2.5 R, 3.1, 108, 229/109, 110, 114, DIG. 2; 220/441, 443, 453, 462, 574

[56] References Cited

U.S. PATENT DOCUMENTS

| | | | |
|---|---|---|---|
| 3,119,540 | 1/1964 | Schenk et al. | 229/114 |
| 3,489,331 | 1/1970 | Andersson | 229/109 |
| 3,792,809 | 2/1974 | Schneider et al. | 229/2.5 R |
| 3,973,721 | 8/1976 | Nakane | 229/DIG. 2 |
| 4,001,471 | 1/1977 | Rumball | 229/109 |
| 4,247,038 | 1/1981 | Forbes, Jr. | 229/108 |
| 4,337,116 | 6/1982 | Foster et al. | |
| 4,533,065 | 8/1985 | Chazal et al. | 220/462 |
| 4,779,758 | 10/1988 | Chazal et al. | 229/110 |
| 5,009,939 | 4/1991 | Goldberg | |

FOREIGN PATENT DOCUMENTS

| | | | |
|---|---|---|---|
| 957301 | 11/1974 | Canada | 229/108 |
| 265760 | 5/1988 | European Pat. Off. | 229/110 |

*Primary Examiner*—Gary E. Elkins

*Attorney, Agent, or Firm*—J. R. McDaniel; W. A. Marcontell; R. L. Schmalz

[57] ABSTRACT

A composite material package in the configuration of a fluid confining bowl with curved or arched side walls is fabricated with a paperboard structural substrate and internally sealed with a blow mold applied film of polymer.

14 Claims, 6 Drawing Sheets

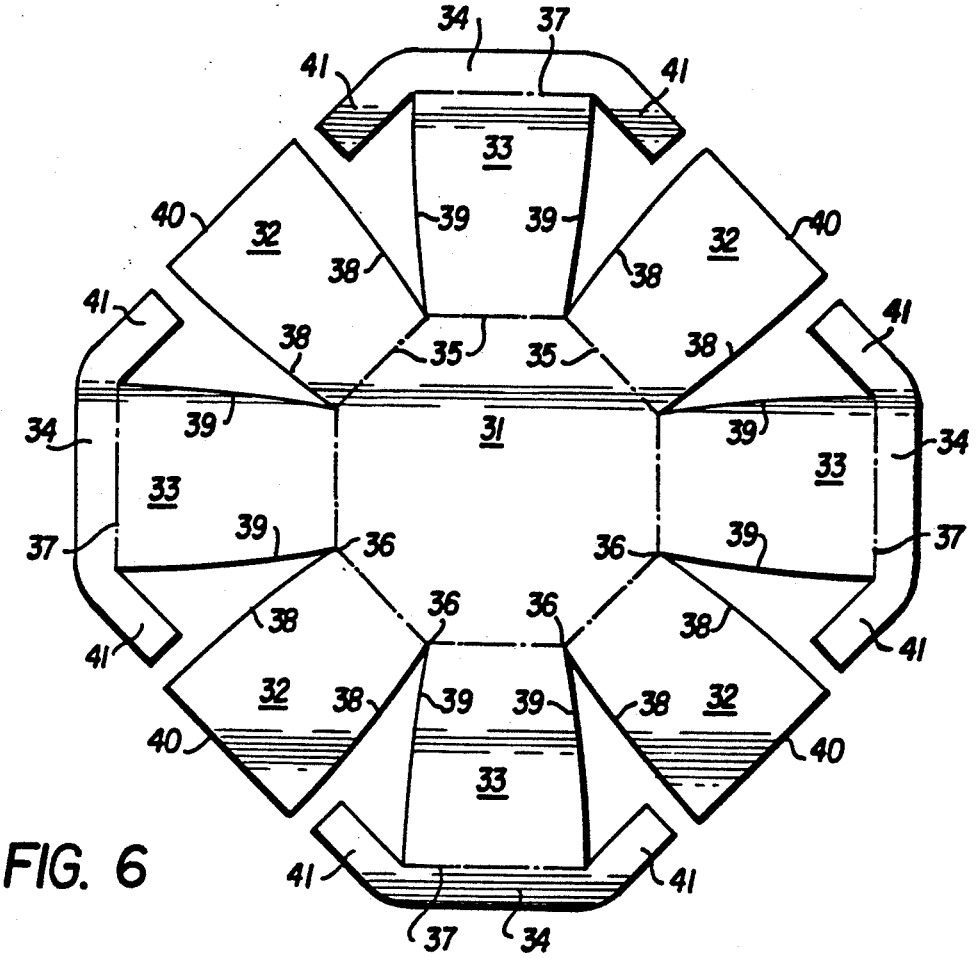
FIG. 6
FIG. 12
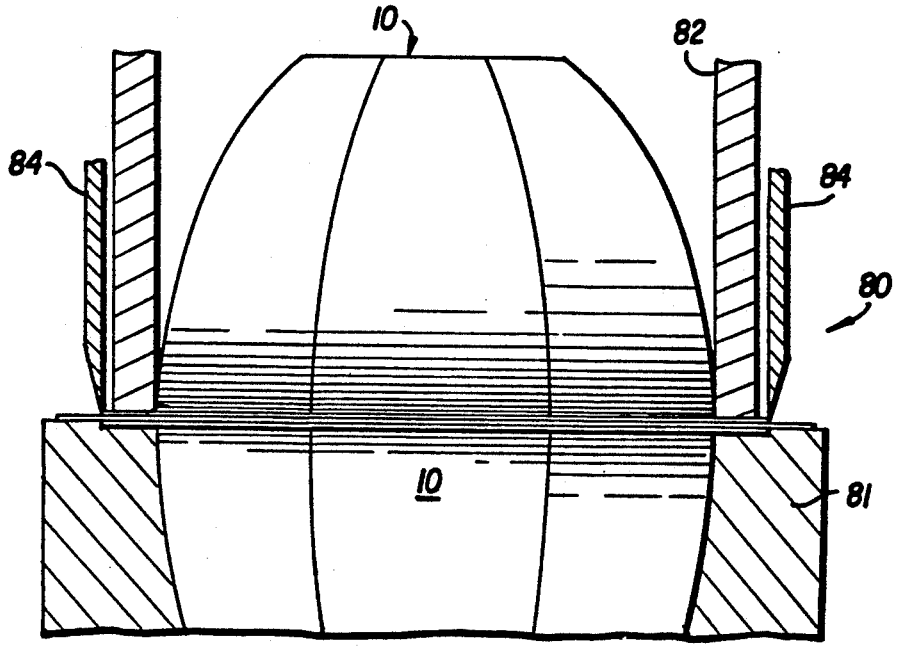

PAPERBOARD BOWL WITH ARCHED WALLS

BACKGROUND OF THE INVENTION

1. Field of the Invention

The present invention relates to a packaging article and corresponding blank component for its manufacture.

2. Description of the Prior Art

U.S. Pat. No. 5,009,039 issued Apr. 23, 1991 to B. A. Goldberg describes a method for fabricating a fluid confining tray having a solid, 0.007 to 0.035 inch thick paperboard sheet substrate blank that is fold erected with corner lapping flaps and confined in pairs within a divided blow mold cavity. A segment of continuously extruded polymer parison tube is clamped and sealed within the cavity by closure of the mold halves. Upon expansion and chilling of the parison segment, the divided mold is opened to release two, oppositely facing, laminated tray structures unitized by an unlaminated band of polymer film. The unlaminated polymer band is subsequently trimmed to separate the two open-top, fluid confining tray products.

Except for rolled corners, the Goldberg tray has a flat plane bottom and walls. Although this construction is surprisingly rigid, the plate buckling property of a flat surface remains.

That geometry generally associated with a food serving bowl includes the compound curve structure of a convex lens. The functional strength and durability of such geometry is unsurpassed. Unfortunately, those compound curves that are characteristic of lenticular surfaces are difficult to transform from paperboard sheet due to the low yield capacity of the material. It has little stretch tolerance before bursting or tearing.

An objective of the present invention, therefore, is to provide a substantially lenticular vessel fabricated from paperboard sheet.

Another object of the present invention is to provide a laminated, fluid confining, paperboard vessel having arched sidewalls.

Another object of the invention is to provide an unusually stiff paperboard bowl having a plurality of curved side wall sections jointed by curved, edge-butt joints which, collectively, closely approximates a true, lenticular geometry.

SUMMARY OF THE INVENTION

These and other objects of the invention are accomplished by means of a bowl blank cut from solid 0.007 to 0.035 inch thick paperboard sheet. The bottom panel of the bowl is supplemented with sidewall panels that are materially integral extensions of the bottom panel. The closed perimeter of the bottom panel polygon is delineated by a circumferentially continuous linkage of straight score/fold line segments. From each fold line segment, a side wall panel is projected; each side wall panel having curved lateral edges, there being two lateral wall edges radiating from each point of bottom perimeter discontinuity. When erected, the flat paperboard sheet planes of side wall panels are bowed or arched into the curved side walls of a blow mold cavity by a vacuum pressure differential. In the arched configuration, lateral edges of adjacent wall panels precisely align to form a wall perimeter corner with no adhesive lap or other structural fastening means.

These edge-to-edge wall joints are exclusively secured by a blow molded film of polymer that is expanded against the interior surface of the corrugated board blank as it is confined in its final erected, position by said blow mold cavity vacuum.

DESCRIPTION OF THE DRAWINGS

In reference to the drawings, like reference characters designate like or similar elements throughout the several drawing figures.

FIG. 6 is a sheet blank diagram from which the first bowl embodiment of the invention is erected.

FIG. 12 illustrates a trimming operation performed on the blow mold raw product.

DESCRIPTION OF THE PREFERRED EMBODIMENT

Figure 1:
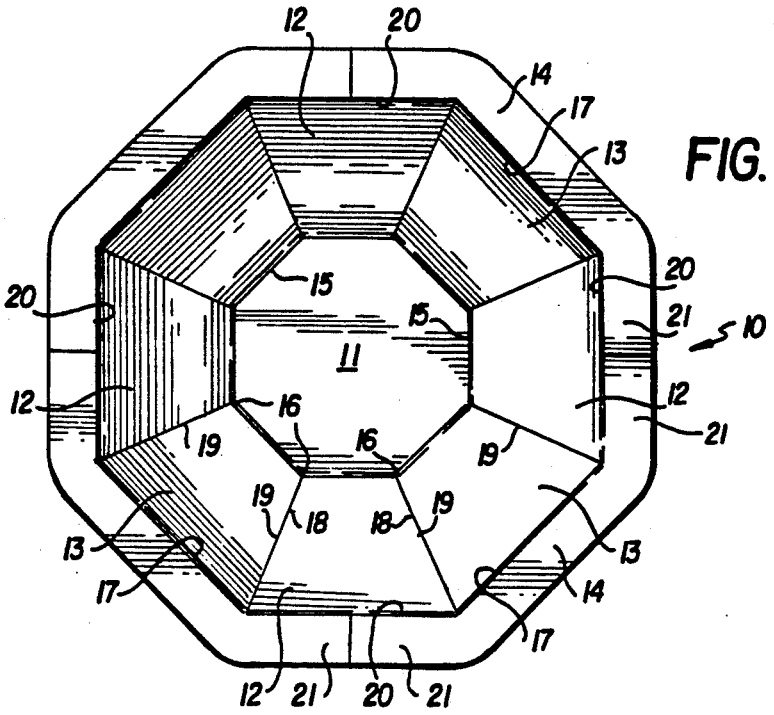
FIG. 1 is a top plan of a first bowl embodiment of the invention.
Figure 2:
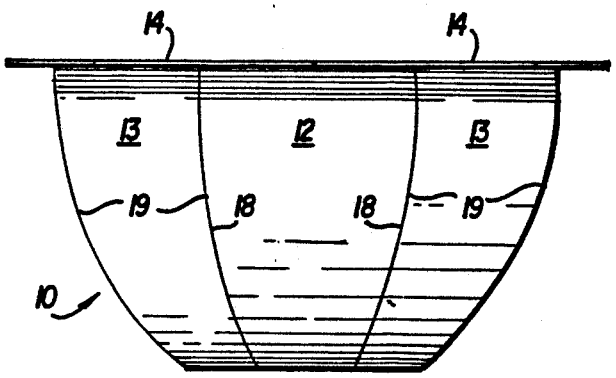
FIG. 2 is an elevation of the first bowl embodiment of the invention.
Figure 3:
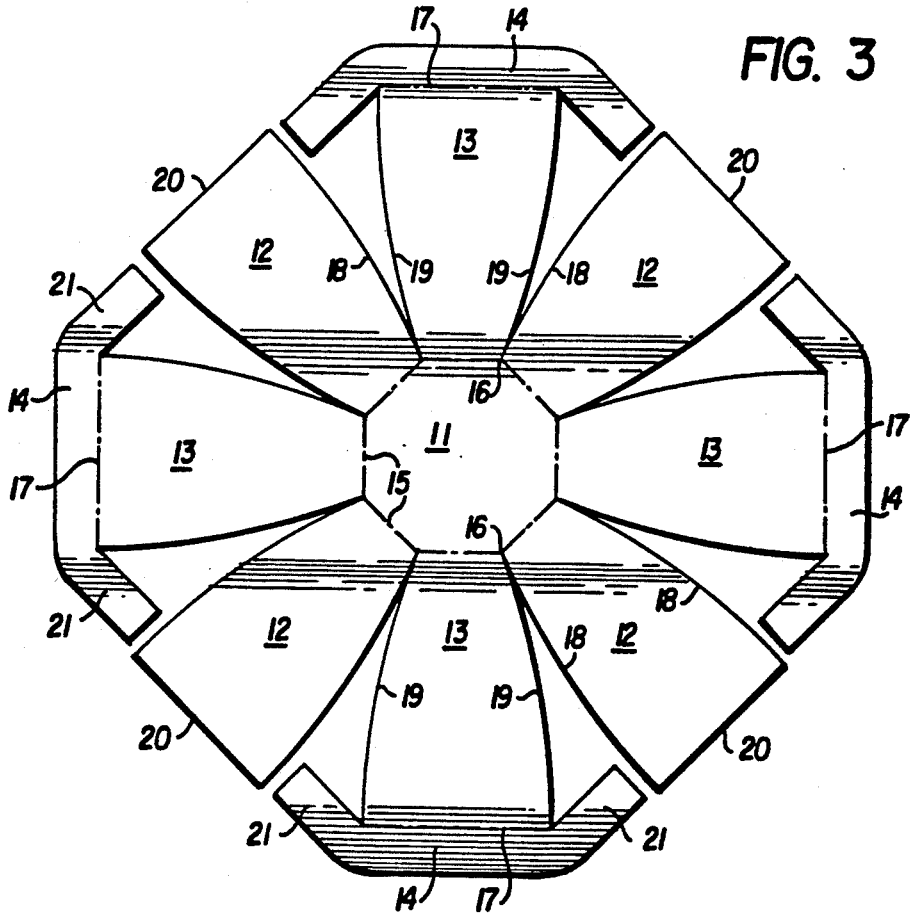
FIG. 3 is a sheet blank diagram from which the first bowl embodiment of the invention is erected.

A first embodiment of the invention is represented by the bowl 10 of FIGS. 1 and 2 which is erected and formed from the paperboard blank of FIG. 3. At the center of the blank is a regular octogon bottom panel 11 defined by eight straight equal length score line segments in the bottom perimeter 15 that are successively connected at points of angular departure 16.

Materially integral with the bottom panel 11 and radiating from the perimeter score line segments 15 are side wall panels 12 and 13. The top edge 20 of wall panels 12 is a plain, straight cut edge that is parallel with the corresponding straight line segments of bottom perimeter score line 15.

Straight score lines 17 across wall panels 13 delineate the top edges of those wall panel sections and respective top flange sections 14.

Most distinctive of the invention are the curved side wall edges 18 and 19 respective to wall panels 12 and 13 which sweep fairly from each point of angular departure 16 to the corresponding top edge 17 or 20.

FIGS. 1 and 2 illustrate the erected result of the FIG. 3 blank. Wall panel edges 18 and 19 are butt joined along their entire lengths from common points 16 to respective top edges 17 and 20. To accommodate this edge alignment, each wall panel 12 and 13 is bowed or arched about an axis of revolution that is at least parallel with the bottom 15 edge of the respective wall panel. Although the wall panel arch may conform to multiple axes of revolution, all such axes for a given panel will be parallel to each other.

From another descriptive perspective, adjacent edge elements 18 and 19 of adjacent wall panels 12 and 13, respectively, are required to meet along their respective lengths at the interface of a common plane. In the case of a normal octagonal bowl, the eight edge meeting planes would be normal to the bowl bottom 11 and intersect along an axis passing through the bowl center. However, such rigid geometry is not absolutely necessary to practice the spirit of the invention.

To complete the erected description of bowl 10, the flange sections 14 are folded outwardly about the top score line 17 with the lateral tabs 21 from adjacent flanges meeting above the top edge 20 of the intermediate wall panel 12.

The aforedescribed erected blank geometry provides no mechanical fastening devices of the traditional type such as interlocking tabs or adhesive laps to secure the relative positionment of the various panels. In lieu thereof, the blank is temporarily restrained to the final erected position and panel alignment by a vacuum holding system internally integrated with a blow mold cavity. While so held, a film of hot, viscous polymer is pressed into the interior paperboard blank surfaces as an expanded parison. When chilled, the polymer film structurally unites the paperboard blank panels as a rigid, integral article.

Figure 7:
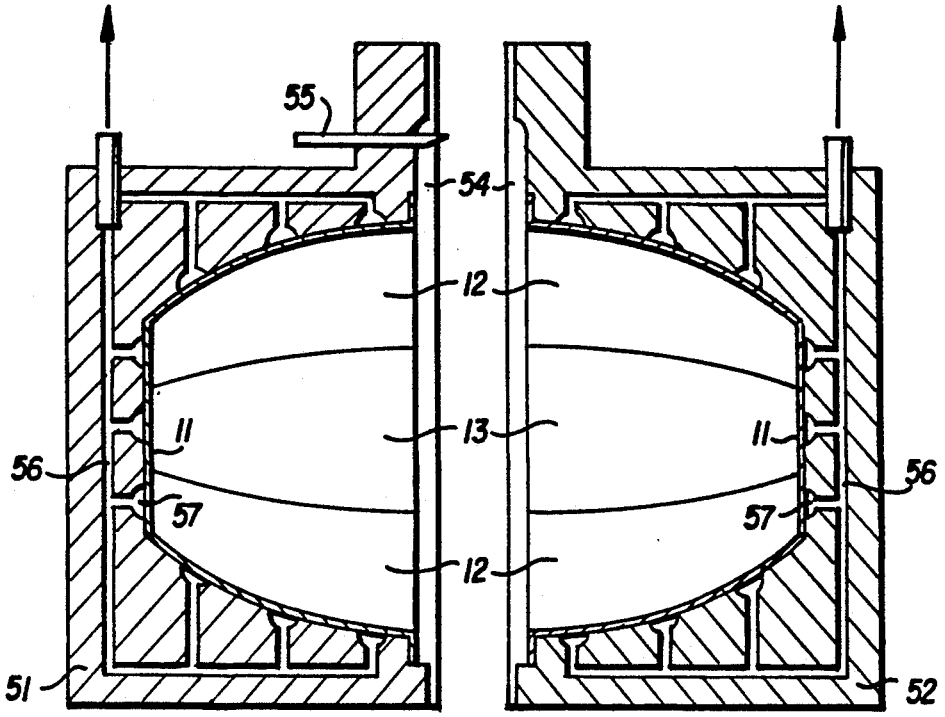
FIGS. 7 through 11 each represent respective stages of the blow molding operation relevant to the present invention.

The foregoing blow molding process is more expansively described relative to the step sequence of FIGS. 7 through 11 wherein FIG. 7 illustrates a bowl blank 10 positioned in each of the mold cavity halves 51 and 52. These mold cavity halves are linked to reciprocate from an open position represented by FIGS. 7, 8 and 9 to a closed position represented by FIGS. 10 and 11. At one end of the mold halves, the product cavities open into a plenum section 54 configured to confine an inflation bulb. Mold half 51 is also provided with a hollow inflation needle 55.

Both mold halves are provided with vacuum conduits 56 having orifices 57. This vacuum system secures the position of an erected bowl blank in each mold cavity prior to film application: these bowl blanks being placed within the respective cavities while the mold unit is open as represented by FIG. 7.

Figure 8:
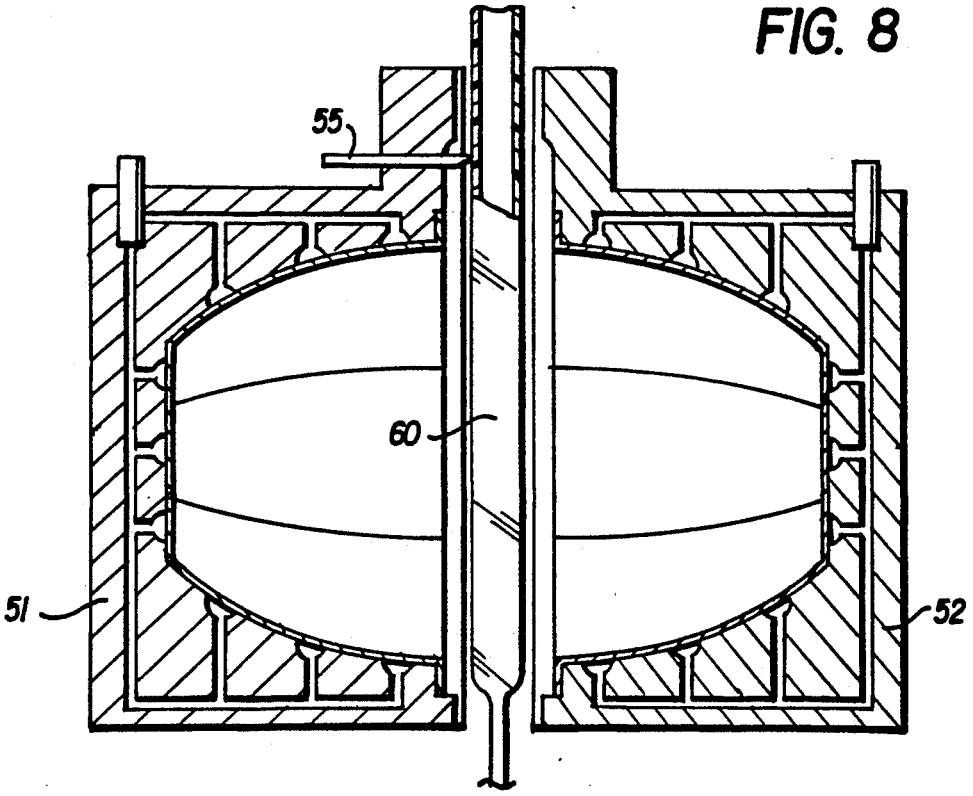

Also while the mold unit is open, a tubular length of 250° F. to 600° F. melted polymer material, known to the art as a parison 60, is extruded between the open mold halves as shown by FIG. 8. More descriptively, the parison 60 is a continuous, vertically hanging extrusion around which the wheel mounted open mold pairs 51 and 52 are positioned tangentially. See FIG. 17, U.S. Pat. No. 5,009,939.

Figure 9:
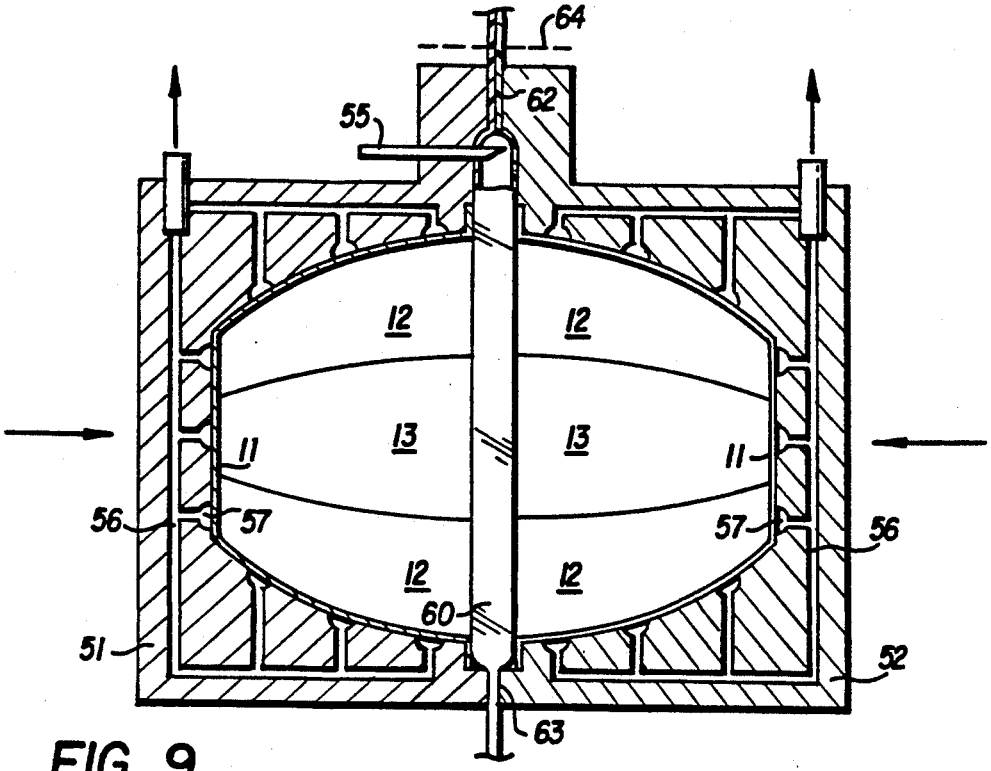

With the bowl blanks and parison 60 in place, the mold halves 51 and 52 are closed upon the parison 60 as represented by FIG. 9 thereby sealing the upper end of the parison along a fused seam 62. The lower or distal end of the parison 60 is sealed along seam 63 by the same mold closure movement.

Figure 10:
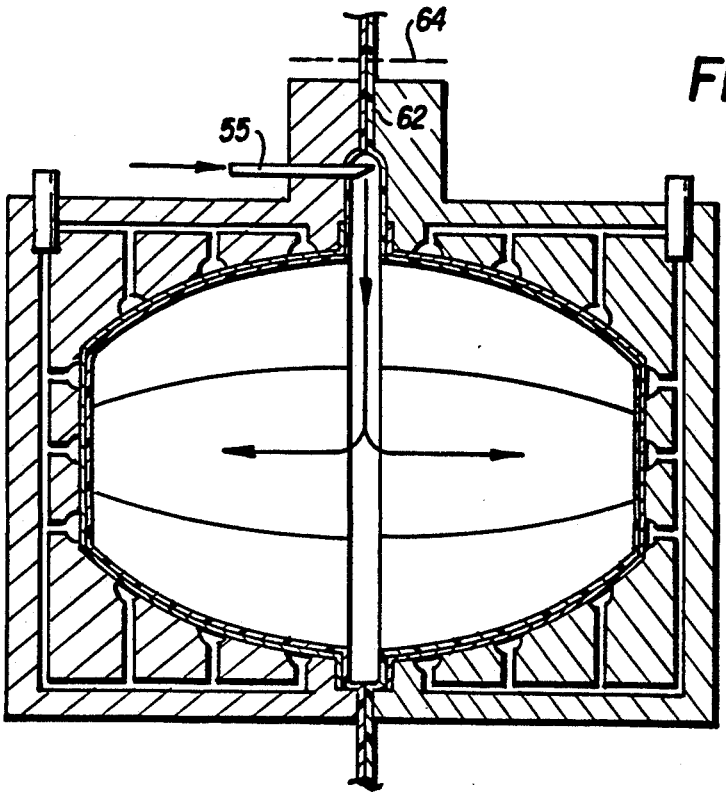

Closure of the mold halves 51 and 52 also pushes the inflation needle 55 through the parison wall film inflation bulb. In this condition, a charge of compressed air or other gas, preferably in the order of 5 to 50 psi, is released through the inflation needle 55 and into the inflation bulb and, consequently, into the closed interior of the parison 60. Such pressure within the parison 60 expands the hot, malleable polymer tube tightly against the mold cavity walls and inner surfaces of the bowl blank as shown by FIG. 10 to drive the polymer into the substrate paper matrix and strongly bonded intimacy.

Figure 11:
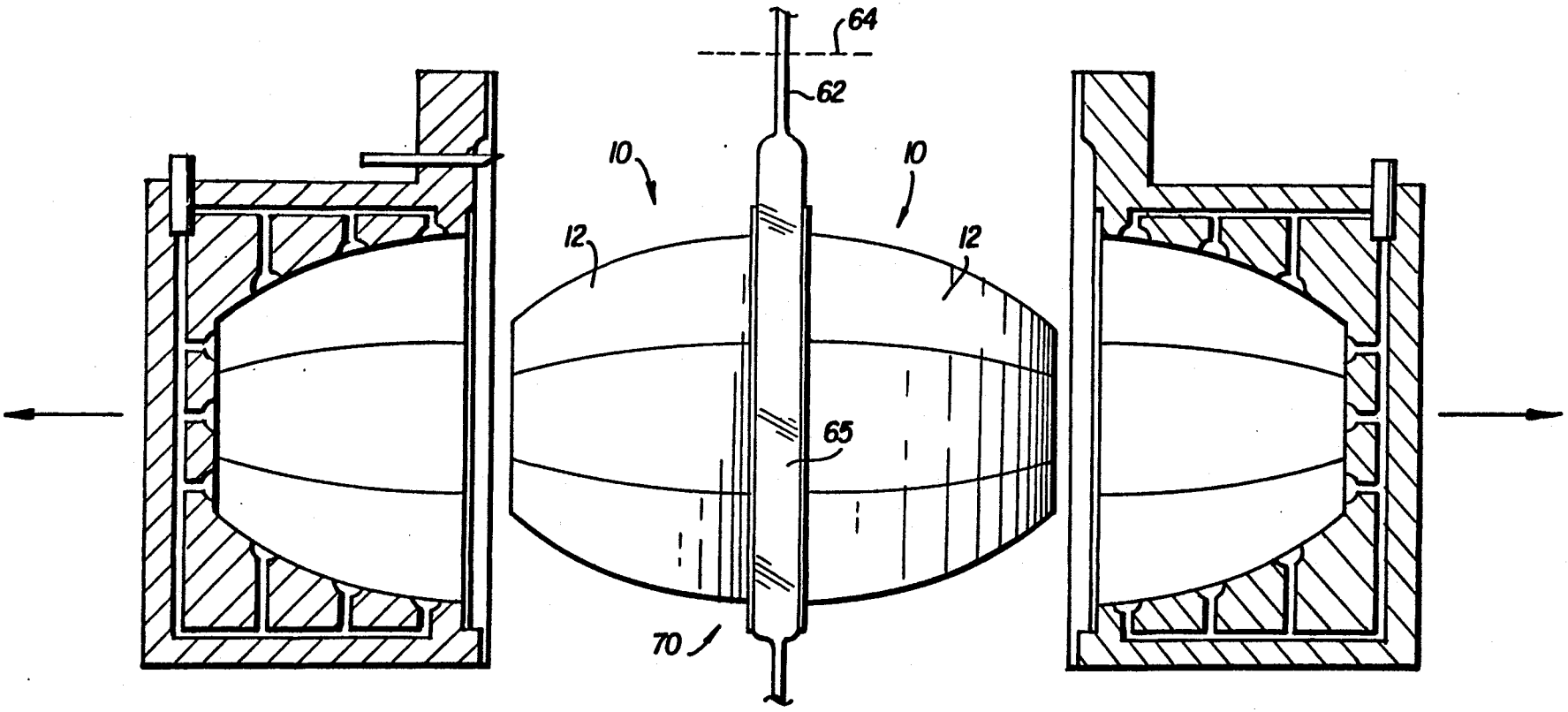

Following a brief chilling interval, the two mold halves 51 and 52 are separated as represented by FIG. 11 leaving the two bowl blanks securely bonded to the inflated parison 60 as a single unit 70. This unit 70 is then separated from the extruded parison continuity by a cut 64 across the fused seam 62.

At this point in the process, unit 70 represents two semifinished bowls 10 joined by a continuous, unlaminated band 65 of polymer which includes the inflation bulb.

Following severance of the parison, the segregated unit 70 is placed upon the anvil element 81 of a cutting die 80. As shown by FIG. 12, striker element 82 engages the underside of the first bowl flange area and presses it against the upper face of the second bowl flange area. Held at this position by die 80, the excess polymer material represented by the band 65 may be trimmed by a shear 84.

Figure 5:
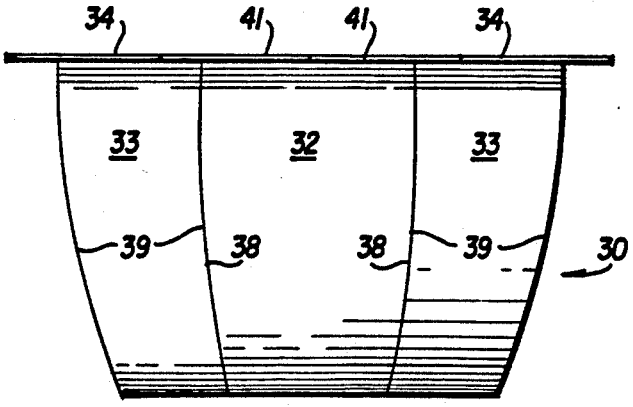
FIG. 5 is an elevation of the second bowl embodiment of the invention.
Figure 4:
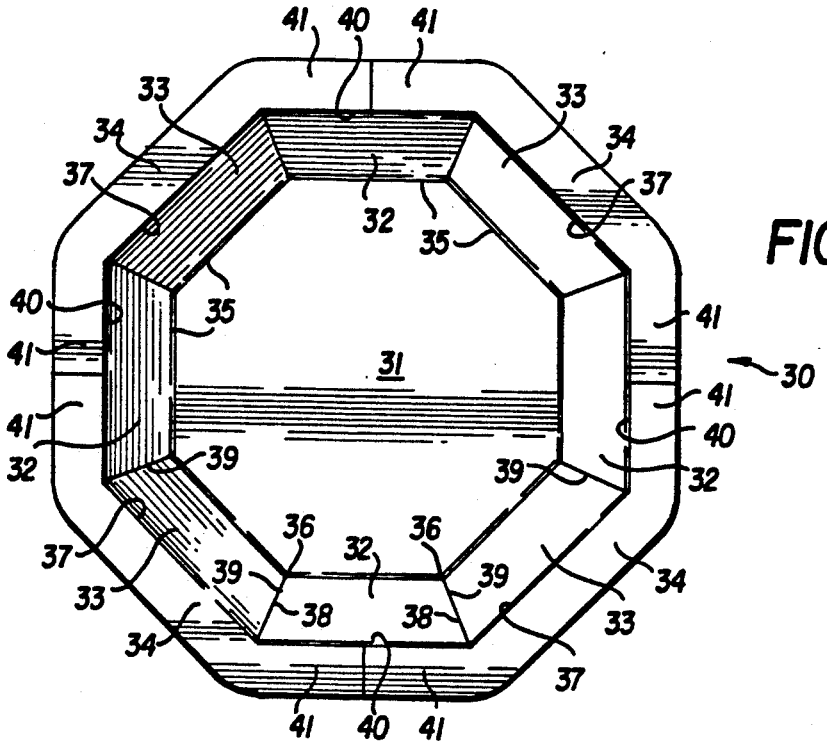
FIG. 4 is a top plan of a second bowl embodiment of the invention.

A second embodiment of the invention is the bowl 30 represented by FIGS. 4, 5 and 6. Like the first embodiment bowl 10, second embodiment bowl 30 comprises a regular octagon bottom panel 31 defined by eight straight, equal length score line segments in the bottom perimeter 35 that are successively connected at points of angular departure 36.

Materially integral with the bottom panel 31 and radiating from the perimeter score line segments 35 are four side wall panels 32 and four side wall panels 33. The top edge 40 of side wall panels 32 is a plain, straight cut edge that is parallel with the corresponding straight line segments of bottom perimeter score lines 35.

Straight score lines 37 across the wall panels 33 delineate the top edges of those wall panel sections and respective top flange sections 34.

As in the first embodiment, curved side wall edges 38 and 39 respective to wall panels 32 and 33 sweep fairly from each point of angular departure 36 to the corresponding top edge 37 or 40.

Bowl embodiments 10 and 30 differ, primarily, in the arch to which the bowl side walls are stressed. Bowl 10 has a very strong or short radius arch in the side walls whereas bowl 30 has a shallow or long radius arch. This side wall arch distinction dramatically influences the vacuum strength requirements of the blow mold forming system to hold the blank in erected position. Conversely, the magnitude of wall arch influences the paperboard thickness that may be restrained in erected position by a given mold vacuum system.

Although both invention embodiments have been described in the context of an octagonal geometry, it should be understood that the simple curve of revolution principles described may be applied to any vessel geometry including pyramids, cubes, pentagons, hexagons, etc. Moreover, the more side wall panels allocated to a given bowl embodiment the less stress is required of the erection restraining system in the blow mold and the more completely the finished bowl article approximates a true lenticular configuration.

Having fully described the preferred embodiments of my invention,

I claim:

1. A fluid container comprising an outer carton blank and an inner blow molded polymer lining wherein said carton blank is further comprised of an integral sheet of paperboard having a planar bottom panel in a shape of a polygon defined by a plurality of straight bottom perimeter score lines continued substantially end to end around a closed perimeter, ends of said score lines meeting at points of angular departure, a plurality of carton wall panels materially integral with said bottom panel and delineated therefrom by said bottom perimeter score lines, said wall carton panels being further delineated by a plurality of curved side edges radiating from one of said points of angular departure respective to the corresponding bottom perimeter score lines whereby an erection of said carton blank to match said curved side edges respective to adjacent said wall panels arcs a plane of said adjacent wall panels such that said blank is formed into a tray, and a polymer lining is in integral contact with said tray to form said fluid container such that said polymer lining is blow molded into contact with said tray.

2. An article blank as described by claim 1 wherein said polygon is a triangle.

3. An article blank as described by claim 1 wherein said polygon is a square.

4. An article blank as described by claim 1 wherein said polygon is a rectangle.

5. An article blank as described by claim 1 wherein aid polygon is a pentagon.

6. An article blank as described by claim 1 wherein said polygon is a hexagon.

7. An article blank as described by claim 1 wherein said polygon is an octagon.

8. A fluid holding article comprising: an outer article blank and an inner blow molded polymer lining wherein said blank is further comprised of an integral, paperboard sheet formed in a configuration having a centralized planar bottom panel defined by a plurality of straight first fold lines continued substantially end to end and from points of angular departure around a closed perimeter of a polygon; each of said first fold lines delineating a bottom edge of a corresponding side wall section also having lateral edges and a top edge; said lateral edges respective to adjacent said side wall sections radiating in continuously faired lines from one of said points of angular departure to said top edges of adjacent said side wall sections; at least one of said top edges of said wall sections being defined by a straight second fold line delineating an adjacent top flange panel; said side wall sections being erected at an angle to a plane of said bottom panel whereby said faired lines of adjacent said side wall edges are erected in substantial alignment within a common plane passing through a mutual point of angular departure respective to said bottom polygon perimeter; and said bottom panel and erected said side walls defining interior surfaces with said side walls being structurally secured at said erected angle to said bottom panel by an integral, continuous, fluid impermeable, blow molded coating of a polymer applied to said bottom panel and said side wall interior surfaces of said formed paperboard sheet whereby said side walls are arched.

9. A fluid holding article as described by claim 8 wherein said polygon is a triangle.

10. A fluid holding article as described by claim 8 wherein said polygon is a square.

11. A fluid holding article as described by claim 8 wherein said polygon is a rectangle.

12. A fluid holding article as described by claim 8 wherein said polygon is a pentagon.

13. A fluid holding article as described by claim 8 wherein said polygon is a hexagon.

14. A fluid holding article as described by claim 8 wherein said polygon is an octagon.

* * * * *